United States Patent [19]

Kobayashi et al.

[11] Patent Number: 4,665,661

[45] Date of Patent: May 19, 1987

[54] CENTRIFUGAL BARREL FINISHING METHOD

[75] Inventors: Hisamine Kobayashi; Atsushi Kato, both of Nagoya, Japan

[73] Assignee: Tipton Manufacturing Corporation, Nagoya, Japan

[21] Appl. No.: 787,785

[22] Filed: Oct. 1, 1985

Related U.S. Application Data

[62] Division of Ser. No. 694,633, Jan. 24, 1985, Pat. No. 4,581,855.

[30] Foreign Application Priority Data

Jan. 27, 1984 [JP] Japan ..... 59-13937

[51] Int. Cl.[4] ..... B24B 1/00

[52] U.S. Cl. ..... 51/313; 51/164.2

[58] Field of Search ..... 51/164.2, 313, 314, 51/164 R; 494/33

[56] References Cited

U.S. PATENT DOCUMENTS 1,491,601 4/1924 Fuller ..... 51/164.2

3,233,372 2/1966 Kobayashi ..... 51/313

4,104,831 8/1978 Kobayashi ..... 51/164.2

FOREIGN PATENT DOCUMENTS 1047703 11/1966 United Kingdom .

*Primary Examiner*—Harold D. Whitehead

*Attorney, Agent, or Firm*—Wenderoth, Lind & Ponack

[57] ABSTRACT

In the centrifugal barrel finishing machine of the type having X barrel assemblies, in which X is an integer, a method finishing workpieces whereby during a given total finishing time Y of the workpieces, each succeeding assembly containing finished workpieces is to be replaced with another assembly containing unfinished workpieces at the end of each time interval of Y/X. The workpieces in each succeeding assembly are finished X number of times each of which is for a duration of time equal to Y/X. In this way, the workpieces in each succeeding assembly can be replaced with workpieces to be finished as the finishing in the preceding unit has been completed, thereby permitting a continuous finishing process and barrel assembly replacement for each succeeding assembly without the need for exchanging the mass in all the barrel assemblies at the same time.

7 Claims, 7 Drawing Figures

CENTRIFUGAL BARREL FINISHING METHOD

This application is a divisional of application Ser. No. 694,633, filed Jan. 24, 1985 now U.S. Pat. No. 4,581,855 issued Apr. 15, 1986.

BACKGROUND OF THE INVENTION

1. Field of the Invention

The present invention pertains generally to finishing technology of metals or other materials, including the manufacture of the machine employing the barrel finishing method and application of that machine for finishing the workpieces.

2. Description of the Prior Art

In the conventional barrel finishing machine of the kind disclosed herein, a plurality of individual barrel-shaped containers are used, which are held rotatably between bearings on a turret capable of high-speed rotation so that the workpieces in each barrel can be subjected to the finishing process, such as surface finishing, deburring milling, stirring, mixing, chemical proceesing, etc. For example, it is known that this type of machine provides a high working efficiency, and it is widely used (as disclosed in the U.S. Pat. No. 3,233,372, which corresponds to British Pat. No. 1,047,703).

For the above prior art machine, however, there is a problem particularly when the lids for the individual barrels are to be removed or remounted and the finished workpieces are to be replaced with unfinished workpieces, since those operations must usually occur during the time interval that the machine is inoperational, and require relatively much loss of time. For example, even when the time required by the machine for its finishing is as short as several minutes, replacing the mass often requires several steps since it must be done for all the barrels, sequentially. Particularly when the number of barrels to be mounted on the machine is large, more time is required for the above operation. In either case, the machine must be inoperational until the mass replacement for all barrels is completed. Thus, it is practically impossible to take full advantage of the high working efficiency provided by the machine. This also imposes limitations on the high productivity that could otherwise be achieved. In the description that follows, it should be understood that the term "mass" refers to the mixture including media, or abrasive media, workpieces and compound solution used for the finishing process, unless it is so mentioned specifically.

SUMMARY OF THE INVENTION

A principal object of the present invention is to solve the above-described problem encountered with the conventional machine. The present invention is provided in the form of a method which achieves the above object. The method is based on the concept of the structural features, which are summarized below. X barrel assemblies each consisting of a number of barrel subunits (or barrel shafts supporting the respective barrel assemblies) are configured to be held rotatably by a turret which is capable of a high-speed rotation, so that they can both rotate axially and revolve orbitally with the turret. Each of the barrel assemblies contains work pieces, abrasive media and compound solution, if necessary, which may be referred to collectively as "contents" or "mass". Thus, during the operation of the machine which is scheduled to run for a total period of time of Y, which corresponds to one cycle of the operation, the workpieces contained in each of the assemblies are subjected to the finishing process for every time interval of Y/X, and at the end of the total time Y, a given assembly which is the first one to have the workpieces to be finished is replaced with a different assembly containing workpieces to be processed. In this manner, the workpieces in each succeeding assembly are subjected to the finishing process for the time interval Y/X which is repeated a number of X times, until the total time of Y for one cycle is reached. Another cycle following the preceding cycle begins, during which the same sequence of operations is repeated for the remaining succeeding units. This sequence is repeated until all of the workpieces are finished and the machine is finally stopped. The method according to the present invention provides an advantage over the method practiced in the conventional machine, since replacement of the workpieces can occur for each succeeding assembly, sequentially, instead of all assemblies at one time. It has the accompanying advantage of saving the physical space and time requirements for the replacement of the workpieces. Another object of the present invention is to provide an improvement to the machine of the type that includes a turret causing both orbital revolution and axial rotation of a plurality of barrels, a corresponding number of barrel holders for holding the respective barrels from above, and a position detector means for setting the turret in position. In its improved form, the machine further includes a barrel rest plate below the turret on which a barrel assembly is placed temporarily and which is capable of traveling up and down, and a circular traveling passage for the barrel assemblies, starting at the barrel rest plate and returning to the same. The circular traveling passage includes several stations which are located at appropriate positions and which have specific functions. The first station is the position where the barrel rest plate is located within the machine. This station provides the function of allowing a barrel assembly to be transferred onto the traveling passage and instead another barrel assembly to be placed on the barrel bed. The second station is where the finished workpieces are discharged from the unfinished workpieces are recharged into each barrel assembly. The third station is a waiting station located between the second and final station, the final station being a feed station from which a barrel assembly is delivered onto the rest plate at the first station. Thus, each succeeding barrel assembly is traveling at regular time intervals through the above stations.

BRIEF DESCRIPTION OF THE DRAWINGS

The above and other objects and advantages of the present invention will become apparent from the detailed description of the preferred embodiments that follows with reference to the accompanying drawings, in which.

DETAILED DESCRIPTION OF THE PREFERRED EMBODIMENTS

Details of the present invention are presented in terms of the method and machine configuration by referring to the accompanying drawings, which illustrate a typical example of the invention.

Figure 1:
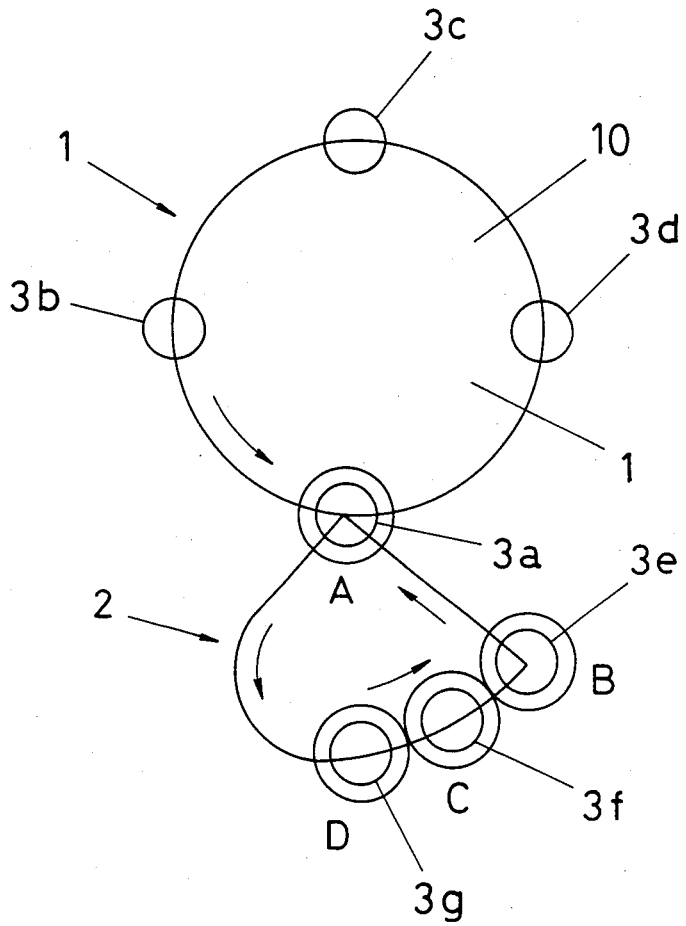
FIG. 1 is a schematic diagram which illustrates the concept on which the method according to the present invention is based.

Referring first to FIG. 1 which illustrates the concept on which the method according to the present invention is based, the conceptual features are described below. As shown in FIG. 1, four barrel assemblies 3*a*, 3*b*, 3*c*, and 3*d*, each consisting of a number of barrel subunits, are placed in their respective positions at regular intervals within the finishing section of the machine, which is generally designated by reference numeral 1. The configuration of the barrel subunits in each assembly will be described later in more detail. The barrel assemblies are held from above by a high-speed rotating turret 10. Three additional barrel assemblies of the identical construction 3*e*, 3*f*, and 3*g* are placed on a circular traveling passage 2 that starts from the finishing section and returns to the same section. Four stations A, B, C, and D are provided along the circular traveling passge 2. The station A is the position from which a barrel assembly containing just finished workpieces is to be delivered out of the finishing section onto the circular traveling passage 2 and to which a barrel assembly containing unfinished workpieces is to be delivered into the above section. The station B allows a next succeeding barrel assembly also containing unfinished workpieces to be ready for traveling forward to the station when it is cleared. The station C is the wait position at which a barrel assembly following the preceding unit, which also contains unfinished workpieces, is waiting until the station B is cleared. Finally, the station D provides the position at which the finished workpieces are to be unloaded from the barrel assembly that has been transferred from the station A and unfinished workpieces are to be loaded in the same assembly.

In The following description, it is assumed, for convenience of easy understanding, that the positions assumed by the individual barrel assemblies as shown in FIG. 1 are their initial positions, the barrel assemblies 3*a*, 3*b*, 3*c*, and 3*d* located within finishing section of the machine being empty and the barrel assemblies 3*e*, 3*f*, and 3*g* located on the traveling passage 2 all containing unfinished workpieces, together with abrasive media and compound solution, if necessary. It is also assumed tht the total running time required for one cycle of the operation is set to, for instance, twenty minutes. At the start of the cycle, then, the empty barrel assembly 3*a* now held by the turret 1 at the station A is lowered down so that it is released from the turret, and is then transferred to the station D. Then, the barrel assembly 3*e* which is waiting at the station B is transferred to the station A, where it is then raised up and secured to the turret 10. After that, the turret 10 now carrying the assemblies 3*e*, 3*d*, 3*c*, and 3*b* is again driven for rotation. The workpieces in the assembly 3*e* are subjected to the finishing process for five minutes (which is equal to the time interval of the total time of 20 min. divided by the number of barrel units, which is four). During the current finishing operation for the assembly 3*e*, the empty assembly 3*a* is further transferred to the station D, while the assemblies 3*f* and 3*g* containing workpieces are transferred to their respective next stations B and C. The empty barrel assembly 3*a* now at the station D is filled with workpieces to be finished as well as abrasive media and compound solution, if necessary. At the end of the above first time interval (five minutes) and when the empty barrel assembly 3*b* held by the turret comes to the position above the station A, the turret is stopped and then the barrel assembly 3*b* is lowered down and released from the turret. After that, the assembly 3*b* is transferred to the station D. The barrel assembly 3*f* with its contents waiting at the station B is transferred to the station A, where it is raised and secured to the turret. When the barrel assembly 3*f* is placed in its up position, the workpieces in the assembly 3*f* are subjected to the finishing process for five minutes. As readily understood, the workpieces within the preceding barrel assembly 3*e* will be finished for an additional five minutes, which adds to the previous five minutes, totaling ten minutes for the assembly 3*e*. The same sequence is repeated for the remaining barrel assemblies that follow the assembly 3*e*, until the first barrel assembly 3*a* is again held by the turret 10 at the station A after traveling around the traveling passage 2. The workpieces in the assembly 3*a* are subjected to the finishing process for five minutes, at the end of which the workpieces in the assembly 3*e* will have been processed for the total time of twenty minutes that was previously set. This concludes one cycle of the operation. At this time, the workpieces for the barrel assembly 3*f* have been processed for fifteen minutes, and those for the assembly 3*g* have been processed for ten minutes. A next cycle of the operation proceeds following the preceding cycle, and the barrel assembly 3*e* containing the completely finished workpieces is unloaded at the station A and is then transferred to the station D, where the contents are removed and unfinished workpieces are refilled together with abrasive media and compound solution, if necessary. Subsequent steps are the same as described above, which occur for each succeeding barrel assembly at every time interval of five minutes. That is, the contents replacing and work finishing operations occur at every time interval of five minutes in the sequence of 3*f*, 3g, 3*a*, 3*b*, 3*c*, 3*d*, 3*e*, 3*f*, and so forth.

Figure 2:
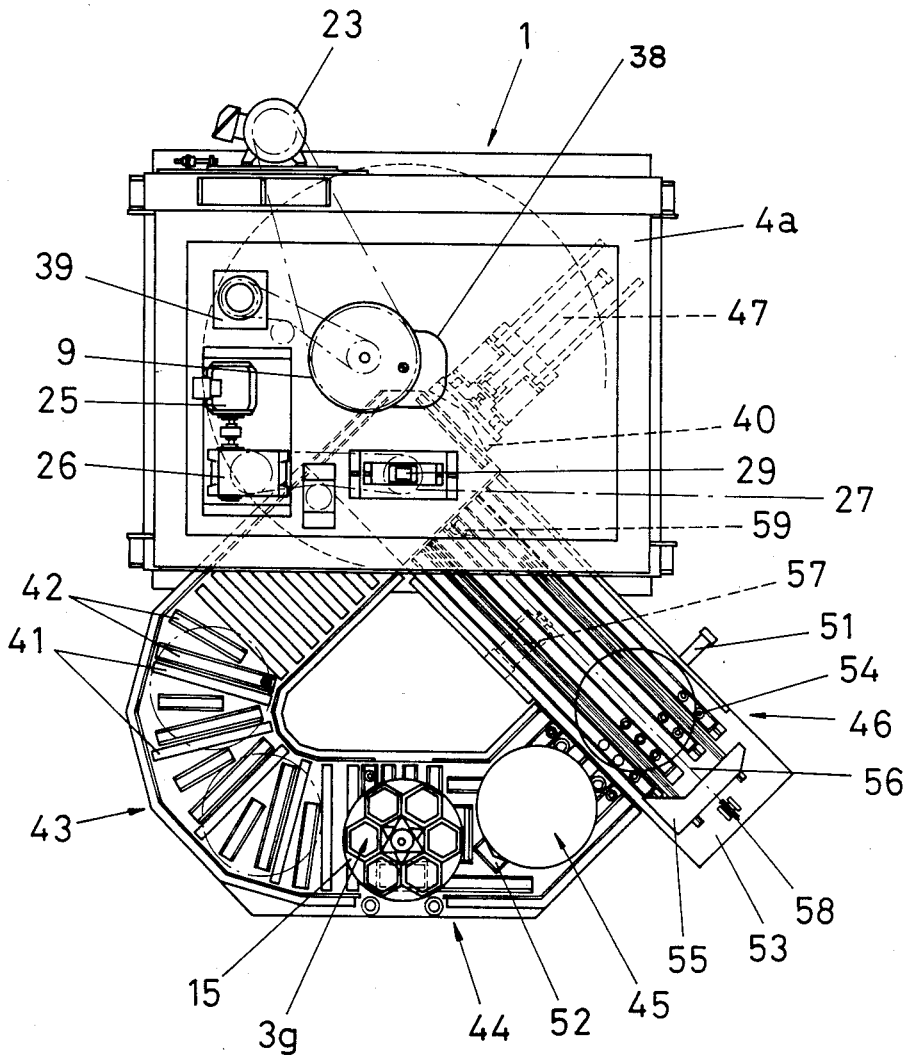
FIG. 2 is a plan view of a preferred embodiment of the machine according to the present invention, with those parts or elements not directly related to the implementation of the invention omitted for clarity of the illustration.
Figure 3:
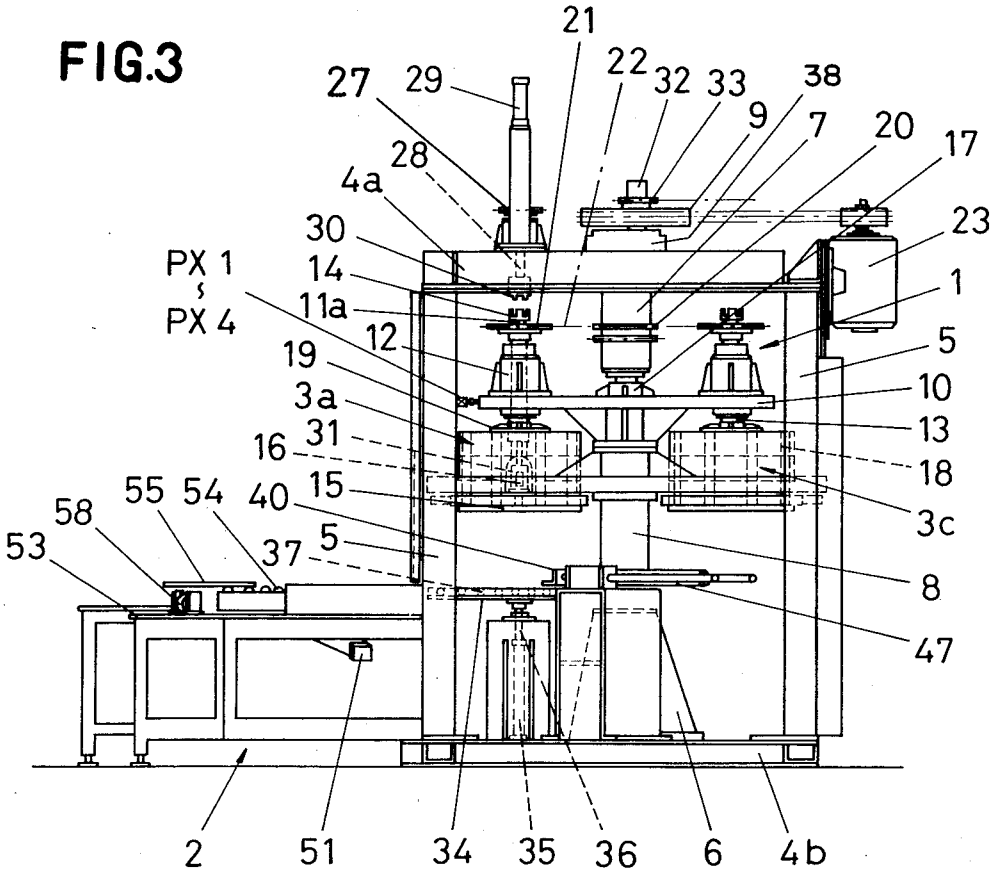
FIG. 3 is a side elevation of the same embodiment in FIG. 2, with the non-related parts or elements omitted for the same reason as in FIG. 2.
Figure 4:
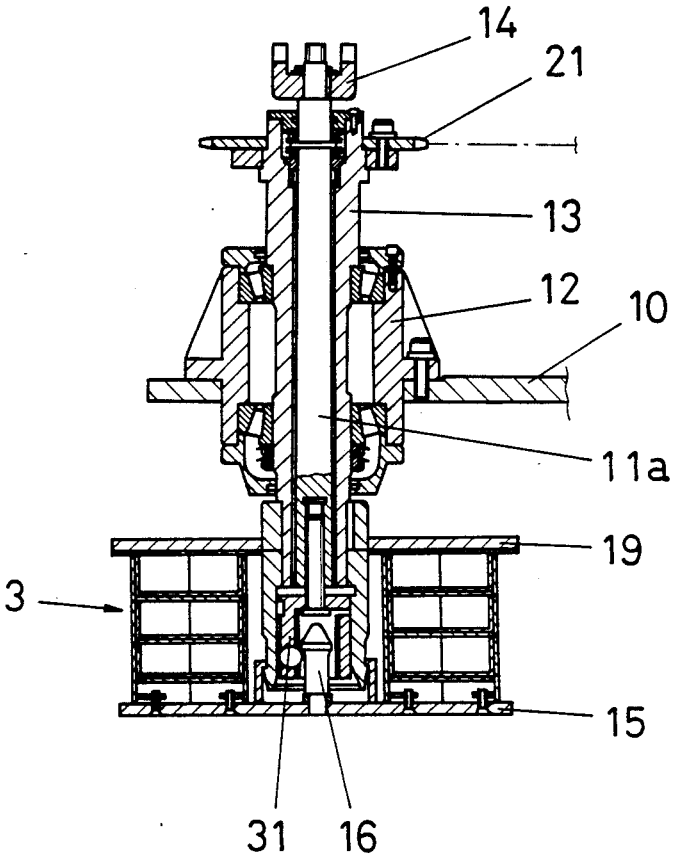
FIG. 4 is a partly enlarged sectional view of the barrel assembly and its shaft.
Figure 5:
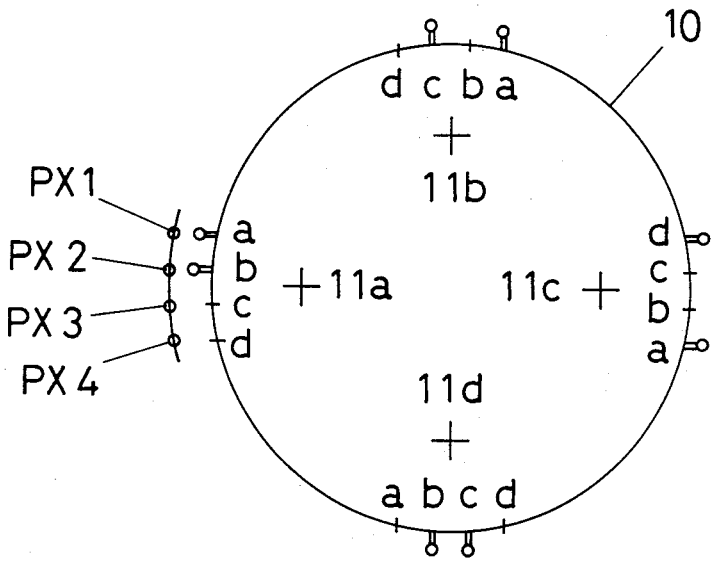
FIG. 5 is a schematic diagram illustrating the relative positions of the micro switches with regard to the corresponding dogs mounted on the turret.

Next, details of the apparatus according to the present invention are provided by referring to FIGS. 2 through 7, which illustrate a typical example of the embodied form. In FIGS. 2 and 3, a structural framework consists of a top horizontal frame 4*a* formed by four sides, a bottom horizontal frame 4*b* formed by four sides, and a number of vertical posts 5, 5 supporting those frames 4*a* and 4*b* in a spaced relationship. The finishing section of the machine 1 is accommodated within the framework such that it is suspended. A circular traveling passage 2 of the barrel assemblies extends away from the above section and circles back to the same section. Within the framework, a central vertical shaft 17 is rotatably supported at the upper end thereof by an upper bearing 7 secured to the top frame 4*a*, and at the lower end thereof by a lower bearing 8 secured through its support 6 to the bottom frame 4*b*. The central shaft 17 carries a main pulley 9 at the top end thereof and a reduction gear 38 is disposed below the main pulley 9. The central shaft 17 also carries a horizontal turret 10 which is secured to the middle portion of the shaft. The turret 10 carries a plurality of barrel shafts spaced at regular intervals adjacent the peripheral edge thereof. In this example, four barrel shafts are provided, but two shafts, front and rear, are not shown in FIG. 3. Although the individual barrel shafts 11*a*, 11*b*, 11*c*, and 11*d* are shown, they will be referred to collectively as the "barrel shaft" for simplicity of the description, unless any specific shaft is mentioned. A bearing 12 is secured to the turret 10 and accommodates a hollow shaft 13 which is rotatably passed through the bearing 12 as shown in FIG. 4. The barrel shaft 11*a* is passed through the hollow shaft 13 so that it can be rotated therein (FIG. 4). The frontal side of the machine framework has four micro switches PX1, PX2, PX3, and PX4 (which will be referred to simply as "PX" unless they are mentioned specifically) which respond to the corresponding pairs of dogs mounted at appropriate positions around the outer peripheral edge of the turret 10. Each pair includes two dogs, and corresponds to the four barrel shafts 11*a*, etc, as shown in FIG. 5. The locations of the two dogs in each pair are different for each different barrel, and a combination of any two of the four micro switches responds to the corresponding pair of dogs. Thus, when the pair of dogs for a given barrel assembly faces any combination of two micro switches, those micro switches respond and determine which barrel has come around to the frontal position (station A) of the machine. In this way, the positioning of any barrel assembly is determined. The locations of two dogs for each barrel shaft are shown in Table 1. In the table, the rows indicate the dog locations a, b, c, and d, and the columns indicate the corresponding barrel shafts 11*a*, 11*b*, 11*c*, and 11*d*. For example, when the micro switches PX1 and PX2 respond, this means that the barrel shaft 11*a* has come to the station A (frontal position).

TABLE 1

| | Dog locations for each barrel shaft | | | |
|---|---|---|---|---|
| barrel shaft | 11a | 11b | 11c | 11d |
| location a | 1 | 1 | 1 | 0 |
| location b | 1 | 0 | 0 | 1 |
| location c | 0 | 1 | 0 | 1 |
| location d | 0 | 0 | 1 | 0 |

Note
0 means no dog
1 means a dog located

At the upper end of the barrel shaft 11*a*, a clutch 14 for clamping the barrel shaft, which engages its counterpart clutch 30 (which will later be described), is secured to the barrel shaft. At its lower end, the barrel shaft has an internally threaded hole of a depth extending longitudinally, which engages an externally threaded rod secured to the upper part of a chuck 31. Thus, rotating the clutch 14 in one direction causes the barrel shaft to rotate in the same direction, so that the rod can progress deeper into the hole, lifting the chuck 31. The barrel assembly, which is made of only urethane, is mounted on a mounting plate 15, the plate 15 having a vertical rod or chuck shaft 16 at the center, which is to be held by the chuck 31. Thus, as the chuck 31 is raised, it holds the vertical rod 16 on the mounting plate 15 and raises the barrel assembly. The barrel assembly, whose construction is later to be described in detail, has an opening at the top, which engages a barrel holder 19 secured to the hollow shaft 13. The barrel holder 19 has a packing beneath it, and the barrel assembly is brought in intimate contact with the packing of the holder. Rotating the clutch 14 in the opposite direction causes the reverse action, which disengages the barrel assembly away from the barrel holder 19. A sprocket 20 is secured to the upper bearing 7 as shown in FIG. 3 and a chain wheel 21 is secured to the upper portion of the hollow shaft 13. A chain 22 is threaded around the sprocket 20 and a chain wheel 21 so that the chain can drive the barrel shaft for rotation. A main motor 23 drives the main pulley 9 for high-speed rotation by way of a belt, connected between the motor and the pulley. A chair wheel 33 having a cam clutch 32 is secured to the top end of the central shaft 17. The chain wheel 33 is operatively associated with an indexing motor 39. A motor 25 which controls the operation of the barrel clamp clutch 14 is provided above the upper frame 4*a* (FIG. 2), and drives a pulley 27 for rotation through a worm gear 26. A clutch shaft 28 is slidable axially up and down inside the pulley 27. The clutch shaft 28 is coupled at its upper end with the piston rod of a fluid cylinder 29 which actuates the clutch 30 so that it can be moved up and down. At its lower end, the clutch shaft 28 has the upper clutch 30 which engages the lower clutch 14. When a given barrel assembly is stopped at the prescribed position, the lower clutch 14 for that barrel assembly faces the upper clutch 30.

A rest plate 34 is disposed below the finishing section of the machine. This plate is provided for allowing the barrel assembly at the prescribed position to be placed thereon, and is supported for up and down movement under control of a fluid cylinder 35, which is vertically disposed below the plate 34. That is, the cylinder 35 has a piston rod 36, to which the plate 34 is secured. Freeway bearings 37 are arranged on the surface of the plate 34. Within the lower frame portion 4*b*, a barrel pusher 40 is provided for pushing the barrel assembly on the rest plate 34 forward onto the traveling passage 2. The pusher 40 is operated under control of a fluid cylinder 47 which is disposed behind the pusher. The cylinder 47 has a piston rod, to which the pusher is secured. The traveling passage 2 includes the above-mentioned rest plate 34, a conveyor 43 which carries a barrel assembly from the rest plate 34 and comprises drive rollers 41 and free rollers 42, a station 44 where replacement of workpieces occurs, a waiting station 45, and a station 46 which moves a barrel assembly forward back to the rest plate 34. The passage 2 is circular as shown in FIG. 2. The conveyor 43 travels between the rest plate 34 and workpiece replacement station 44, and drive rollers 41 and free rollers are arranged across the conveyer passage and at regular intervals along the length of the passage, such that free rollers 42 are interposed between two adjacent drive rollers 41. Each of the drive rollers 41 is driven by its own motor so that each can be driven independently. For this purpose, the motor manufactured by Itoh Denki K. K., Japan in the trade name of POWERMOLLER may be employed. Each of the drive rollers 41 also has a micro switch (not shown), which responds upon sensing the approach of a barrel assembly, activating the drive motor which in turn drives the roller 41. At the workpiece replacement station, discharge and charge of workpieces usually occurs, but barrel replacement may also occur.

Figure 6:
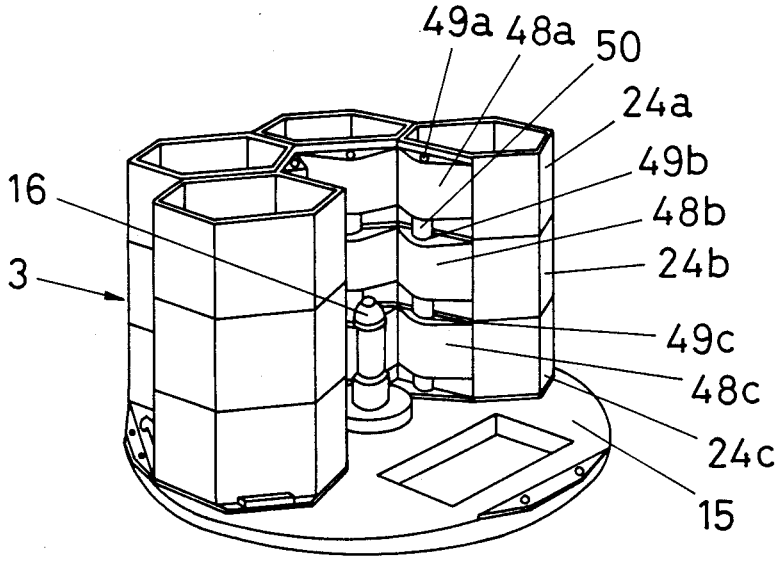
FIG. 6 is an enlarged perspective view showing the configuration and arrangement of a given barrel unit mounted on its mounting plate.
Figure 7:
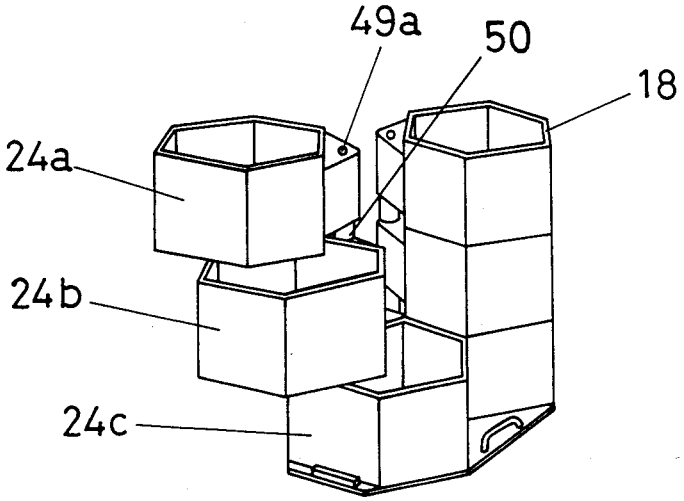
FIG. 7 is an enlarged perspective view showing how a given barrel unit is arranged in the layered or stacked configuration.

Now, the structure of the barrel assembly 3 is described by referring to FIGS. 6 and 7. A single barrel assembly is mounted on its mounting plate 15, and consists of three pairs of barrel subunits as shown in FIG. 6. In each pair, the barrel subunits are two parallel sets of subunits, each set consisting of a plurality of individual units as indicated by 24*a*, 24*b*, and 24*c* in FIG. 7 which are stacked to provide a layered configuration. In each set, the individual units are assembled together as shown in FIG. 6. In FIG. 6, each of the individual subunits has a protruded portion 48*a*, 48*b*, or 48*c* on its rear side, the protruded portion having an assembly hole 49*a*, 49*b*, or 49*c* extending through each portion. A single assembly rod 50 is passed through the holes 49*a*, 49*b* and 49*c*, thereby assembling the individual subunits. Thus, the individual subunits can be pivotted on their common rod 50 independently of each other, as shown in FIG. 7. Referring back to FIG. 2, at the barrel wait station 45, a hook 52 is provided which is secured to the piston rod of a fluid cylinder 51. The hook 52 engages the barrel assembly, and is moved longitudinally when the cylinder 51 withdraws its piston rod. Thus, the hook 52 pushes the barrel assembly forward.

The station 46 for allowing the barrel assembly to travel back onto the rest plate 34 includes a conveyor base 53 running in the direction of the travel of the barrel assembly and perpendicular to the preceding traveling passage, free-way bearings 54 arranged on the conveyor base 53, and a pressure plate 55 which is capable of travel along the length of the conveyor base 53 to push the barrel assembly from behind onto the rest plate. The pressure plate 55 is attached to a chain 56 which is driven by a reversible motor 57 mounted on the conveyor base 53. The chain 56 is threaded around sprocket wheels 58 and 59 on the opposite sides thereof, and reciprocates forward and backward.

The operation of the apparatus is now described in accordance with its construction that has been illustrated heretofore.

For purposes of convenience of the description, it is assumed that at the initial stage of the operation, the turret 10 within the finishing section of the machine 1 carries barrel assemblies 3*a*, 3*b*, 3*c*, and 3*d* which are all empty, that is, contain no workpieces and abrasive media, with the barrel assembly 3*a* being now positioned just above the rest plate 34, while barrel units 3*g*, 3*f*, and 3*e* each containing abrasive media and compound solution are placed at their respective workpieces replacement station 44, barrel wait station 45, and barrel transfer station 46. As in the preceding description of the concept of the method shown in FIG. 1, it is also assumed here that the total running time required for one cycle of the operation is set to, for instance, twenty (20) minutes. The following description is based on the above assumptions.

The first step is to cause the barrel rest plate 34 to travel up to receive the barrel assembly 3*a*. This is accomplished by introducing a pressurized fluid into the piston side of the fluid cylinder 35. Then, a pressurized fluid is introduced into the piston side of the clutch cylinder 29, causing the upper clutch 30 to be lowered. When the clutch 30 has engaged the lower clutch 14, the clamp motor 25 is started. The motor 25 turns for a fixed period of time, causing the barrel shaft 11*a* to rotate. In this case, the motor and barrel shaft are rotated in the direction of permitting the chuck 31 to be lowered. As the chuck 31 is lowered, the chuck shaft 16 on the barrel assembly mount plate 15*a* is released from the chuck 31. Then, the plate 15*a* is placed on the barrel rest plate 34. After this, a pressurized fluid is introduced into the piston rod side of the fluid cylinder 35, causing the rest plate 34 to travel down. In its lower position, the mount plate 15*a* is pushed forward onto the conveyor 43 by introducing a pressurized fluid into the piston side of the fluid cylinder 47. This is accomplished by the pusher 40 being acted upon by the above piston so that the pusher 40 can push the plate 15*a* from behind. As described earlier, all barrel assemblies are permanently mounted on their own mount plates 15, and so when any barrel assembly is mentioned, it is meant to include the mount plate carrying that barrel assembly. As the same time as the barrel assembly 3*a* has been transferred onto the conveyor 43, the motor 57 is started, driving the chain 56 which causes the pressure plate 55 to move the barrel assembly 3*e* on the transfer station 46 toward the barrel rest plate 34. When the station 46 is cleared, a pressurized fluid is introduced into the piston rod side of the fluid cylinder 51. With the retracting piston rod, the transfer hook 52 is pulled toward the cylinder 51, transferring the barrel assembly 3*f* now at the wait station 45 onto the transfer station 46. The barrel assembly 3*g* at the work replacement station 44 is then manually transferred to the wait station 45. For the barrel assembly 3*a* which has been transferred onto the conveyor 43, the micro switch on the first drive roller 41 responds to the approach of the barrel assembly 3*a*, starting the motor to drive that drive roller. Then, the micro switch on the second drive roller responds similarly, causing the motor to drive that drive roller. In this way, the drive rollers are driven sequentially, and finally the barrel assembly 3*a* is transferred to the work replacement station. For the barrel assembly 3*e* now on the rest plate 34, which contains unfinished workpieces, a pressurized fluid is introduced into the piston side of the fluid cylinder 35, which causes the rest plate 34 to travel upwardly. When the rest plate comes to its raised position, the clamp motor 25 is started for reverse rotation during a fixed period of time. This causes the barrel shaft 11*e* to rotate in the direction of raising the chuck 31, which holds the chuck rod 16 on the mount plate 15*e*. Thus, the barrel assembly 3*e* is held by the turret's barrel holder 19. Next, a pressurized fluid is introduced into the piston rod side of the clutch cylinder 29, lifting the upper clutch 30 away from the lower clutch 14. Then, the main motor 23 is started, and the turret 10 is rotated. As described in conjunction with the method, the finishing operation occurs at every time interval of five (5) minutes. During this time interval, the finished workpieces contained in the barrel assembly 3*a*, which is now at the station 44, are exchanged with workpieces to be processed next. At the end of that time interval, the main motor 23 is stopped, and the indexing motor 39 is started. The turret 10 is indexed until the barrel assembly 3*b* is positioned just above the rest plate 34. When the barrel assembly 3*b* reaches that position, the micro switches PX1 and PX2 respond to the corresponding dogs (a and c) for the barrel shaft 11*b*, which are located on the turret 10, stopping the indexing motor 39. Subsequent operations occur in the same manner at every time interval of five minutes, and at the end of each time interval, one barrel assembly is unloaded from the finishing section while instead one barrel assembly is loaded into the same section. At the end of the total time of twenty minutes for one cycle, the barrel assembly 3*e* is unloaded from the finishing section and is then transferred to the mass replacement station 44, where the mass replacement takes place. Thereafter, the assembly 3*e* goes through the different stations and back to the above section. Then, a new cycle proceeds, the above described steps occurring at every time interval of five minutes.

As readily understood from the detailed description of the method and apparatus that has been made with reference to the typical examples of the present invention, the finishing operation by the machine and mass replacing operation can occur alternately for each succeeding barrel assembly, and the machine has only to be inoperational when one barrel assembly is replaced by another barrel assembly at the station A in FIG. 1, at the end of each time interval. Also, the mass replacing operation can occur during the machine operation. Therefore, the present invention is advantageous not only in saving labor and energy but also taking the fullest advantage of the working efficiency that the machine can provide.

Although the invention has fully been described by referring to the embodiments thereof, it should be understood that various changes and modifications may be made without departing from the spirit and scope of the invention.

What are claimed are:

1. A centrifugal barrel finishing method using a plurality of barrel assemblies which are carried by a high-speed rotating turret, each assembly consisting of barrel subunits each containing an appropriate amount of workpieces to be finished, an appropriate amount of abrasive media, and compound solution, if necessary, thereby subjecting the workpieces in each barrel assembly to the finishing process by causing both orbital revolution and axial rotation of the barrel assemblies with the turret, automatically chucking and unchucking the barrel assemblies to and from barrel shafts rotatably supported on the turret, transporting the barrel assemblies outside of the barrel finishing machine on a conveyor to a mass exchanging position and then with a pusher pushing the barrel assemblies with unfinished workpieces back into the barrel finishing macnhine, which comprises:

setting the total period of time required for one cycle of the finishing operation for the unfinished workpieces in each of a plurality of barrel assemblies;

sequentially replacing each barrel assembly containing finished workpieces with another barrel assembly containing unfinished workpieces at the end of equal time intervals, the equal time periods being of a duration equal to the total period of time divided by the number of barrel assemblies supported on the turret;

continuing the sequential finishing operations continuously, except for the replacing duration of the barrel assemblies.

2. A method as defined in claim 1, wherein each of the barrel assemblies has a structurally identical configuration.

3. A method as defined in claim 1, wherein a plurality of barrel units in the sequence are supported in a balanced relationship by the turret.

4. A method of finishing workpieces in a centrifugal barrel finishing apparatus which includes a high-speed rotating turret, a plurality of barrel assemblies each of which is rotatably mounted on the turret such that workpieces in the barrel assemblies are subject to both orbital revolution due to rotation of the turret and axial rotation due to rotation of the individual barrel assemblies, the barrel finishing apparatus further including means for sequential automatic chucking and unchucking of the barrel assemblies to and from barrel shafts rotatably supported on the turret and conveyor means for transporting barrel assemblies to and from a first position at which the individual barrel assemblies are chucked and unchucked to and from the barrel shafts, the conveyor means including a portion thereof for transporting a plurality of barrel assemblies into abutting relationship with each other adjacent a second position from which one of the barrel assemblies is transported to the first position, the method comprising:

finishing workpieces contained in the barrel assemblies mounted on the turret for sequential, equal time periods;

sequentially replacing a different barrel assembly on one of the barrel shafts at the end of each of said time periods; and setting the total time period for finishing the workpieces in an individual barrel assembly equal to the duration of one of said equal time periods times the number of barrel assemblies mounted on the turret.

5. The method of claim 4, wherein finished workpieces are removed from each barrel assembly after it is unchucked from the turret and transported by the conveyor means to a third position at which it abuts the plurality of other barrel assemblies on the conveyor means.

6. The method of claim 4, wherein the barrel assemblies are pushed by a pusher from the second position to the first position.

7. The method of claim 4, wherein the barrel assemblies are sequentially replaced on the barrel shafts in consecutive order such that an individual barrel assembly is not removed from its barrel shaft until the barrel assemblies mounted on the remaining barrel shafts have been replaced only one time, whereby at the beginning of each finishing step one barrel assembly contains unfinished workpieces.

* * * * *